United States Patent [19]

Webster

[11] Patent Number: 4,585,497

[45] Date of Patent: Apr. 29, 1986

[54] METHOD OF SEALING CONTAINERS USING HEAT SEALABLE CAP STOCK

[75] Inventor: William R. Webster, Fredericksburg, Va.

[73] Assignee: Allied Paper Incorporated, Kalamazoo, Mich.

[21] Appl. No.: 547,943

[22] Filed: Nov. 2, 1983

[51] Int. Cl.[4] ..... B32B 31/12

[52] U.S. Cl. ..... 156/69; 53/478; 53/487; 53/488; 156/216; 156/224; 215/232; 215/326; 215/DIG. 2; 428/64; 428/352; 428/354; 428/514; 493/109; 493/114

[58] Field of Search ..... 53/478, 487, 488; 156/69, 183, 216, 224, 226; 215/232, 326, DIG. 2; 428/505, 506, 514, 352, 354, 64; 493/108, 109, 114

[56] References Cited

U.S. PATENT DOCUMENTS

| | | | |
|---|---|---|---|
| 2,586,446 | 2/1952 | Stockburger | 215/38 |
| 2,649,392 | 8/1953 | Marshall | 154/83 |
| 2,829,791 | 4/1958 | Berst | 216/9 |
| 2,845,213 | 7/1958 | Tamarin | 229/51 |
| 2,984,573 | 5/1961 | Smith | 99/172 |
| 3,259,507 | 7/1966 | Smith | 99/172 |
| 3,974,112 | 8/1976 | Nadler et al. | 524/501 |
| 4,050,121 | 9/1977 | Richman | 24/73 VA |
| 4,075,372 | 2/1978 | Wilkinson | 427/258 |
| 4,202,925 | 5/1980 | Dabroski | 428/219 |
| 4,258,529 | 3/1981 | Smith | 53/478 |
| 4,352,702 | 10/1982 | Bornstein | 156/84 |

OTHER PUBLICATIONS

*Air Products and Chemicals Bulletin,* "Airflex Ethylene-Vinyl Chloride (EVC) Emulsions for Specialty Paper", 8 pages (1981).

*Primary Examiner*—Robert A. Dawson
*Attorney, Agent, or Firm*—Richard H. Thomas

[57] ABSTRACT

The present invention relates to a glue-free method for sealing closures to paperboard food containers, and also to the novel closures for such method. The present invention is particularly applicable to containers for moisture sensitive food items such as salt, and is characterized in the use of a thermoplastic vinyl chloride ethylene copolymer which functions both to provide a heat seal and effective resistance to moisture vapor transmission. The copolymer has sufficient slip to permit handling of the closures in automatic forming and heat sealing equipment.

12 Claims, No Drawings

METHOD OF SEALING CONTAINERS USING HEAT SEALABLE CAP STOCK

TECHNICAL FIELD

The present invention relates to a non-glue method for sealing closures to paperboard food containers, and also to the novel closures for such method. The present invention is particularly applicable to containers for moisture sensitive food items such as salt.

The invention will be particularly described with reference to the common cylindrically shaped salt box container, such as a Morton Company salt box, although it will be apparent to those skilled in the art that the present invention has other applications.

BACKGROUND ART

Paperboard closures which are used for cylindrical food containers, such as cylindrical salt boxes, are frequently made of a material known as cap stock. Conventionally, such cap stock is formed from flat paperboard by first making circular cutouts of the paperboard and then drawing such cutouts into shallow cup-shaped caps. Glue is applied to the portions of the cylindrical containers which are overlapped with the caps when assembled. After application of the glue, the caps are placed over the container open end, or ends, and the overlapping portions are pressed together and held in such position until a suitable bond is formed by the applied glue. Usually, the cutting, drawing, glueing, positioning and closing steps take place in an assembly-type operation, in a continuous manner.

The conventional cap stock which is in use today employs recycled board as a substrate. The outer surface of the substrate is covered with a bleached white liner board adhered to the substrate by a suitable adhesive. The opposite inner side of the substrate is covered with a virgin brown liner board adhered to the substrate by a polyethylene adhesive. The polyethylene adhesive, in addition to having adhesive properties, also functions as a moisture barrier to the transmission of moisture from the outside to the ingredients within the container, for instance salt. The use of virgin brown liner board on the substrate inner side is necessary because of contact of the cap with food items.

In drawing the cap stock, the circular cutouts, which may be about 4" in diameter, are provided with a rim of about ⅜" in height. It is this rim which overlaps a part of the container sides when the drawn cutouts are seated on a container open end. Thus, glue must be applied to an exposed container end for about the same distance as the rim height (about ⅜").

A problem with this conventional process is the need for the use of glue, the accompanying glue pots, and attendant difficulty in cleaning equipment and glue pots after shutdown or between runs. A glue-free procedure would have obvious advantages.

It has been proposed to reduce the cost of the cap stock by replacing the laminate with a recycled board coated with a moisture barrier coat, such as a polyvinylidene chloride coat. While this may reduce the cost of the cap stock, it still requires the step of glueing the cap to the container, in turn incurring the attendant costs associated with glueing, such as cleaning of glue pots.

U.S. Pat. No. 2,586,446 to Stockburger, describes a closure said to be particularly useful for glass bottles. The closures, which are formed from a plurality of layers of cellulosic material, are adhered to the bottles or other containers by means of a plastic cement such as vinyl acetate, vinyl chloride copolymer, polyethylene, polyvinyl chloride and the like. The plastic cement bond is achieved by a combination of heat and pressure applied by means of a forming die used to form the cap or closure over the container open end. The plastic cement is said to have a greater adherence to the laminate than it does to the receptical, and in this respect it is emphasized in the patent that the bond that it forms with the receptical is readily breakable by simply hand twisting the closure.

The closure is said to be gas-impervious and also water tight, although it is indicated in the patent that the closure may permit gradual passage therethrough of water vapor. It is suggested that some plastic cements may have water vapor imperviousness.

In the method of this patent, a roll of closure film is fed to a capper head wherein it is cut into short lengths or segments which are then positioned between the capper head and a bottle to be closed. The capper head is heated to a temperature above the temperature at which the plastic cement on the film is adherent to the bottle. The head has a recess which presses the center of the severed piece of film firmly onto the top of the bottle and presses the skirt of the closure firmly against the sides of the bottle. The combination of the heat and pressure forms a tight seal between the closure and bottle. The disclosure of this patent is incorporated by reference herein.

A Crown-Zellerbach U.S. Pat. No. 3,259,507 describes a heat-sealable seal for food packages comprising a laminate which is composed of a base sheet, an intermediate release or delaminating layer, and an inner adhesive layer, which is said to be heat activatable. The purpose of the release layer is to permit the base sheet, which seals the package, to be removed when access to the package is desired. There is no reference in the patent to the presence of a release coat on the base sheet opposite to side of the adhesive coat, or to moisture resistant properties of the adhesive coat.

It is well known to coat a substrate on one side with an adhesive and the other side with a release coat. This is shown, by way of example, in Johnson U.S. Pat. No. 4,202,925, directed to a tape, and in Avery International U.S. Pat. No. 4,050,121, directed to a tab. The subject matters of these patents are not closures in the same sense as in the present invention.

Other patents illustrating the prior art include a Kraft Foods U.S. Pat. No. 2,649,392 on a cover of chlorinated rubber, heat sealable to a container of vinyl chloride acetate. The cover is said to be readily peelable from the container. An Alton Boxboard Co. U.S. Pat. No. 4,075,372 describes the use of ethylene vinyl chloride as a flexible precoat on boxboard and paperboard to alleviate cracking and fracturing along a scored or folding line. The precoat is top coated with a ladquer having moisture barrier properties. A Phillips Petroleum Co. U.S. Pat. No. 4,258,529 describes a cover for containers comprising a metal foil substrate and top and bottom thermoplastic coatings. Also, Metal Box Limited U.S. Pat. No. 4,362,002 describes a laminate strip for making closures comprising a paper substrate and a coating of a polymer of ethylene and acrylic acid. There is no reference in this patent to release or slip properties of the laminate strip.

Patents on heat seals for use in packaging include W. R. Grace & Co. U.S. Pat. No. 4,352,702; Tamarin U.S.

Pat. No. 2,845,213; Smith U.S. Pat. No. 2,984,573; and Berst U.S. Pat. No. 2,829,791. The Smith patent is directed to art related to that of the Crown-Zellerbach U.S. Pat. No. 3,259,507, mentioned above.

DISCLOSURE OF THE INVENTION

The present invention constitutes an improvement in the art in the provision of cap stock for cylindrical paperboard food containers comprising a paperboard substrate in the form of a circular blank; a thermoplastic adhesive coating applied to one side of said substrate; a slip coating applied to the opposite side of said substrate, said thermoplastic adhesive coating being a thermoplastic vinyl chloride ethylene copolymer having amide functionality and a vinyl chloride to ethylene ratio in the range of about 75:25 to about 85:15. The coating is applied at an effective weight to achieve a moisture vapor transmission rate in the cap stock of less than about 5 grams/100 sq. inches/24 hrs., as determined by TAPPI test T-448.

Preferably, the slip coating is an alkali soap applied in an amount effective to provide slip in automatic forming equipment.

The present invention is unique in providing, with the combination of a plastic film on one side and a slip release coat on the opposite side, a specific combination of properties; namely, adequate slip release for use in automatic cap stock handling and forming equipment, heat sealing strength wherein the coat is heat sealed to uncoated paperboard, and adequate resistance to moisture vapor transmission.

The present invention also resides in a method for glue-free application of cap stock to cylindrical paperboard food containers comprising the steps of; passing flat cut circular blanks of said cap stock to a forming die, each of said blanks comprising a paperboard substrate, a slip release coating applied to one side of the substrate, and a thermoplastic vinyl chloride ethylene copolymer having amide functionality applied to the opposite side of said substrate, said copolymer having a vinyl chloride to ethylene ratio in the range of about 75:25 to 85:15; forming said blanks into the shape of a shallow cup; placing said blanks over an open end of said container; and heat sealing the overlapping surfaces of said container and blanks by the application of an effective amount of heat thereto, said vinyl chloride ethylene copolymer being present at a coat weight effective to achieve a moisture vapor transmission rate in the cap stock of less than about 5 grams/100 sq. inches/24 hours.

The present invention will become more apparent upon consideration of the following detailed description of the invention, with reference to the example thereof.

BEST MODE FOR CARRYING OUT THE INVENTION AND INDUSTRIAL APPLICABILITY

In the practice of the present invention, the containers of principal interest to which the present invention is directed are cylindrical containers of cellulosic or paperboard stock known as tube stock or can stock, which are especially adapted for handling of food items, especially moisture-sensitive food items such as salt. More specifically, one such container is a salt box container, which is cylindrical in form, of spirally-wound laminated boxboard known as jute board. The board laminates, normally two in number, are adhered together by a layer of asphaltic adhesive material. The containers themselves are about 3¼ inches in diameter to about 5¼ inches in height. Normally, the bottom end of each container is closed with a solid paperboard cap, the top end being fitted with a cap having a pouring spout which is pivotably movable between open and closed positions. Suppliers of can or tube stock include St. Regis Paper Co. and Sonoco, Inc.

In conventional practice, the cylindrical containers, after being formed and severed to desired size, are capped at one end in a continuous line, and then are inverted so that the remaining open end is facing upward. The containers are then passed to a filling station where they are filled, and then to a capping station for closing said open end.

A feature of the cylindrical containers is that they are uncoated on the outside. Most heat seals are formed between layers of like thermoplastic materials. Conventionally, as indicated above, the caps have been sealed to the containers in a glueing operation. Normally, an effective heat seal is not obtainable between a substrate coated with a thermoplastic material and an uncoated substrate.

Prior to the capping step, the caps are formed by die cutting rolls of cap stock into a series of essentially circular wafers, at a die cut station. The wafers are stacked in a feed tray, and then are shuffled off of the bottom of the stack and fed to a punch step where they are formed into a shallow cup shape. In the punch step, the edges of the wafers are held by two superimposed clamping rings. Following the punch step, the caps are turned over in a suitable guide, are placed over the open end of the salt box containers, at a rotating turret station, and then are sealed to the container open ends. It is a feature of the present invention that such conventional steps and equipment will be utilized. However, instead of glue sealing the formed caps to the containers, the present invention contemplates the use of heat-sealing jaws which grab the caps and apply heat and pressure to them to seal the caps to the containers.

In a number of the above operations, slip is required of the cap stock; for instance in shuffling the cylindrical wafers from the bottom of the feed tray, in the clamping ring during the punch operation, and in the heat-sealing step. In the latter, slip is required between the heat-sealing ring and the cap stock outer surface. In the feed and punch operations, slip is required on both sides of the cap stock.

Because of the use for the cap stock, and the handling operations involved, there are a number of requirements or specifications which are critical.

One is the moisture vapor transmission rate (MVTR) as determined by TAPPI Test T-448. Moisture vapor transmission through paperboard is more likely to occur and adversely affect moisture sensitive foods, such as salt, than water transmission, and therefore the moisture vapor transmission rate is generally considered to be a more critical parameter than the water transmission rate. In accordance with the present invention, the MVTR is less than 5 grams, preferably less than 2.5 grams.

The substrate paperboard preferably has a thickness sufficient to resist adverse effects from handling, both during manufacture and, subsequently, during marketing and use by the consumer. The paperboard also has sufficient thickness to retain its cup shape following drawing. For these purposes, white lined paperboard about 20–30 mils thickness, preferably about 28 mils thickness, was found to be very satisfactory. The substrate paperboard preferably has a water penetrability of about ½ to 1½ minutes, as determind by TAPPI Test T-492, for optimum coat adhesion. Preferred specifications for the cap stock, following coating, are a caliper of about 0.027 to 0.031 inches, (as determined by ASTM Test D-645), a moisture content of about 6–10%, and a basis weight of about 108 to about 125 lbs./1,000 sq. feet (⅓ ream), as determined by ASTM Test D-646.

The slip or release coating which is applied to the side of the substrate paperboard, opposite the side of the thermoplastic coat, may be any of a large number of materials having slip release properties. A preferred such material is an alkali metal soap of a fatty acid, such as sodium or calcium stearate, applied at a coat weight of about 0.2–0.5 lbs/ream. Other suitable release agents, such as other stearates, waxes, silicones or Quilon (trademark of E. I. DuPont de Nemours), can be used. A requirement of the slip or release agent is that it be effective in permitting slip or release in automatic forming and handling equipment.

Normally, in the case of a soap such as calcium stearate, it is applied as a very dilute solution (about 5% solids), containing a small amount of binder such as styrene butadiene latex (about 0.2%).

The vinyl chloride ethylene copolymer coat can be a single vinyl chloride ethylene copolymer, or a blend of such copolymers. If desired, various additives, such as a wax, can be added to the copolymer to enhance properties such as slip.

The copolymers are marketed as emulsions (at about 50% solids content) and comprise a small amount of a third acrylamide monomer, imparting amide functionality. The ratio of vinyl chloride to ethylene can be in the range of about 75:25 to 85:15.

The copolymers are marketed by Air Products Company under the trademark Airflex. The following is pertinent data for two such copolymers successfully employed in the practice of the present invention.

TABLE I

| | Airflex 4514 | Airflex 4530 |
|---|---|---|
| Molecular weight (approx.) | 30000 | 30000 |
| Vinyl chloride/ethylene ratio | 75/25 | 85/15 |
| Glass transition temp, Tg. °C. | 14° C. | 30° C. |

The 4514 having a lower glass transition temperature exhibits good flexibility, slightly more than the 4530. A glass transition temperature less than about 30° C. permits drawing the cap stock without film rupture. Both the 4514 and 4530 have good resistance to blocking and good water resistance. The 4514 has slightly better thermoplasticity than the 4530.

The following Table II gives slip values for coatings of 4514, 4530, and blends thereof, applied to 28-point, whitelined newsback, at a coat weight of about 12 lbs./ream.

TABLE II

| Composition | Slip Value |
|---|---|
| Airflex 4514 | 78 grams |
| Airflex 4530 | 38 grams |
| 3/1 ratio of Airflex 4514/4530 | 70 grams |
| 1/3 ratio of Airflex 4514/4530 | 58 grams |

The slip values were determined by cutting samples 2×2 inches square and placing the same on a stainless steel plate, coated side down. 147 gram weights were placed on the samples, and the values given are the resistance determined to pull the samples across the stainless steel plate at the rate of 12 inches per minute.

A slip value less than 70 grams is desirable, preferably less than about 60 grams, for use in conventional cap stock handling and forming equipment. Up to about 10% wax, for instance a synthetic wax emulsion such as Nopcote DS-101 (trademark of Diamond Shamrock), can be added to the 4514, or 3/1 blend, to bring the slip value to less than about 60.

By comparison, an extruded polyethylene coat exhibited far too little slip for use in conventional cap stock handling and forming equipment.

An optimum combination of slip value and moisture vapor transmission rate was obtained with a 50/50 blend of 4514 and 4530, as follows:

TABLE III

| Coat weight lbs./ream | MVTR grams | Slip grams |
|---|---|---|
| 7 | 3 | about 60 |
| 9 | 2 | about 60 |
| 12 | 1 | about 60 |

With this blend, a coat weight of at least about 9 lbs./ream was preferred, to give an MVTR value less than about 2.5.

By comparison, a paperboard substrate coated with Saran, which has good resistance to moisture transmission, exhibited poorer MVTR data, because of voids.

Following heat sealing, the coatings of the present invention exhibited excellent seal properties with the uncoated container walls, to the extent that the laminates of the container were subject to fiber tear or ruptured before the seal did. Normally, the seal is effected with about 5–6 seconds of heat, at a temperature of about 300° F.–400° F. and a pressure of about 5–10 psi. An application temperature of about 300°–400° F. raises the vinyl chloride ethylene coat to above the seal temperature.

For purposes of the present application, the term "seal temperature" is defined as that temperature required to establish a bond between the coat and container stock with which the coat is in contact. Airflex 4514 and 4530 have published seal temperatures of 210° lF. and 230° F., respectively. The actual seal temperatures. in the present invention are believed to be at least as high.

Although the principal test used for heat seal effectiveness is fiber tear, seal strength tests were conducted in a Schopper Tester, which clamps the two sealed pieces and pulls them apart, in opposite directions, (a 180° pull) at a preset rate. At a coat weight of 7–10 lbs./ream, using a pull rate of 22 inches per minute, seals made at seal temperatures of 225°–350° F. gave seal strengths of 3 lbs. to 4½ lbs. The tests were conducted with both St. Regis Paper Company and Sonoco tube or can stock, bonded to the cap stock of the present invention.

EXAMPLE

In this example, 28-point, white-lined newsback was coated in a single pass with a vinyl chloride-ethylene coat on one side, by a wire wound rod, and sodium stearate on the other side, using a conventional Dahlgren remoisturizer. The board had a water penetrability value, as determined by TAPPI test T-492, of about ½ to 1½ minutes. The vinyl chloride-ethylene coat was a 50/50 blend of Airflex 4514 and 4530.

The vinyl chloride-ethylene coat was applied first, at a coat weight of about 9 lbs./ream, following which the strip of board was coated with calcium stearate at a coat weight of about ¼ to ½ lbs./ream.

The coated board was cut into circular discs of about 10½ cms in diameter. These discs were formed into shallow cups, in a conventional forming line. In the cutting stage, the stacking stage, where the discs were stacked, and in the forming stage, the discs showed adequate slippage. Following forming, the discs were placed over the open ends of containers, in a conventional filling and capping operation. During the capping step, the discs were heat sealed by application of heat through the sidewalls of the cap in the areas which were overlapped. The pressure exerted by the heat sealing ring was firm, but insufficient to distort the container wall. In the heat sealing step, the cap was heated to about 375° F. and held at that temperature for a duration of about 3 seconds. This was sufficient to elevate the temperature of the coating to above its seal temperature, but insufficient to scorch the board.

After heat sealing, the cap and board were tested for tear strength and it was found that the underlying container was subject to fiber tear or delaminated before the bond formed by the coating fails. The product had a moisture vapor transmission rate of about 2 grams.

In the heat sealing step, no friction difficulties were experienced.

I claim:

1. A method for glue-free application of cap stock to cylindrical paperboard containers comprising the steps of (a) passing flat, cut, circular blanks of said cap stock to a forming die, each of said blanks comprising a paperboard substrate, a slip release coating applied to one side of the substrate, and a thermoplastic, vinyl chloride ethylene copolymer having amide functionality applied to the other side of said substrate, said copolymer having a vinyl chloride to ethylene ratio in the range of about 75:25 to about 85:15;

(b) forming said blanks into the shape of a shallow cup;

(c) placing said blanks over an open end of said container; and (d) heat sealing the overlapping surfaces of said container and blanks by the application of an effective amount of heat thereto, said vinyl chloride ethylene copolymer being present at a coat weight effective to achieve a moisture vapor transmission rate in the cap stock of less than about 5 grams/100 sq. inches/24 hours;

wherein the vinyl chloride ethylene copolymer forms a bond having an adherence to the container wall effective to cause fiber tear in the container wall before bond rupture, said paperboard containers being uncoated.

2. The method of claim 1 wherein said slip release coating is an alkali metal soap.

3. The method of claim 2 wherein said ethylene/vinyl chloride copolymer has a slip value effective to permit its use in automatic handling and forming equipment.

4. Containers manufactured by the method of claims 1 or 2 or 3.

5. The containers of claim 4 for moisture sensitive foods.

6. Cap stock for cylindrical paperboard containers comprising (a) a paperboard substrate in the form of a circular blank;

(b) a thermoplastic adhesive coating applied to one side of said substrate;

(c) a slip coating applied to the opposite side of said substrate;

(d) said thermoplastic adhesive coating having amide functionality;

a vinyl chloride to ethylene ratio in the range of about 75:25 to about 85:15; and a slip value effective for its use in automatic handling and forming equipment;

(e) said vinyl chloride ethylene copolymer being present at a coat weight effective to achieve in the cap stock a moisture vapor transmission rate of less than about 5 grams/100 sq. inches/24 hours;

wherein said vinyl chloride ethylene copolymer is adapted to form a bond with uncoated cylindrical paperboard containers following heat sealing, effective to cause fiber tear in the container wall before bond rupture.

7. The cap stock of claim 6 wherein said slip release coating is an alkali metal soap.

8. Containers sealed with the cap stock of claims 6 or 7 for moisture sensitive foods.

9. The method of claim 1 wherein said vinyl chloride ethylene copolymer is blended with 0–10% of a wax emulsion.

10. The cap stock of claim 6 wherein said vinyl chloride ethylene copolymer is blended with 0–10% of a wax emulsion.

11. The method of claims 1 or 9 wherein said vinyl chloride ethylene copolymer is a blend of one copolymer having a vinyl chloride/ethylene ratio of about 75/25 and another having a vinyl chloride/ethylene ratio of about 85/15 in a blend proportion effective to optimize heat seal and slip properties.

12. The cap stock of claims 6 or 10 wherein said vinyl chloride ethylene copolymer is a blend of one copolymer having a vinyl chloride/ethylene ratio of about 75/25 and another having a vinyl chloride/ethylene ratio of about 85/15 in a blend proportion effective to optimize heat seal and slip properties.

* * * * *